US005152343A

United States Patent [19]

Kilgore

[11] Patent Number: 5,152,343

[45] Date of Patent: Oct. 6, 1992

[54] REELED TUBING GAS LIFT MANDREL

[75] Inventor: Marion D. Kilgore, Dallas, Tex.

[73] Assignee: Otis Engineering Corporation, Dallas, Tex.

[21] Appl. No.: 706,944

[22] Filed: May 29, 1991

[51] Int. Cl.[5] ..... E21B 17/00; E21B 17/02

[52] U.S. Cl. ..... 166/242

[58] Field of Search ..... 166/242, 117.5, 372, 166/380, 378; 137/155; 417/109, 172

[56] References Cited

U.S. PATENT DOCUMENTS

| | | | |
|---|---|---|---|
| 2,904,058 | 9/1959 | Cummings | 137/155 |
| 3,066,690 | 12/1962 | Tausch | 127/155 |
| 3,124,151 | 3/1964 | Lilly | 137/155 |
| 4,628,995 | 12/1986 | Young et al. | 166/242 X |
| 4,844,166 | 7/1989 | Going, III et al. | 166/372 X |
| 5,018,575 | 5/1991 | Parsons | 166/242 |
| 5,033,550 | 7/1991 | Johnson et al. | 166/372 |
| 5,056,599 | 10/1991 | Comeaux et al. | 137/155 X |

*Primary Examiner*—Hoang C. Dang
*Attorney, Agent, or Firm*—Johnson & Gibbs

[57] ABSTRACT

A gas lift valve mandrel especially adapted for mounting on reeled tubing used in a well including a mandrel body in at least two sections comprising a gas lift valve adapter and a clamp which are secured together around the tubing, the adapter including structure for mounting a gas lift valve and flow passages communicating into the gas lift valve and into a bore through the mandrel through which the tubing extends, the flow passage in the adapter communicating with a port in the tubing when the mandrel is mounted on the tubing and further including a seal in the adapter for sealing with the tubing around the port into the tubing. An alternate form of the mandrel includes a pipe plug hole and a pipe plug in the adapter for access to the flow passage in the adapter to drill the port into the tubing when the mandrel is mounted on the tubing during the mounting procedure. The mandrel is readily secured on the tubing at desired locations as the tubing is run into a well.

24 Claims, 3 Drawing Sheets

REELED TUBING GAS LIFT MANDREL

This invention relates to systems and methods for the installation of such systems for the production of well fluid from earth formations by gas lift and more particularly relates to gas lift mandrels and the installation of such mandrels on the coil tubing utilized as production tubing for producing well fluids from wells penetrating earth formations.

BACKGROUND OF THE INVENTION

It is known in the oil and gas well production art to produce such wells using coil tubing which is a continuous conduit without joints carried on a reel from which the tubing is lowered into a well into which lift gas is to be injected for production of fluids from the well. Apparatus and a method of installation of such apparatus for completing a well with coil tubing including a well completion utilizing gas lift valves and mandrels is illustrated and described in U.S. Pat. No. 4,844,166, issued Jul. 4, 1989. Such patented well equipment includes one or more gas lift valves installed in tubular mandrels which are connected into and form a part of the coil tubing string through which fluids are produced from the well by injection of gas into the coil tubing through the gas lift valves and passages in the gas lift mandrels. In the prior art devices such as the patented apparatus it is necessary to cut the coil tubing and splice the gas lift mandrel into and connect the mandrel with the coil tubing by suitable coil tubing crossover pin thread connectors, thereby permanently securing the gas lift mandrel into the coil tubing string as an integral part thereof at a fixed location along the length of the tubing string. At each location along the coil tubing string that a gas lift mandrel is desired, the tubing string is cut and the mandrel installed as described. A gas lift valve is connected into each of the gas lift mandrels as also illustrated in the referenced patent.

SUMMARY OF THE INVENTION

It is a principal object of the present invention to provide new and improved apparatus and installation methods for connecting gas lift valves into a coil tubing for production of fluids from a well using injection gas and the like.

It is another object of the invention to provide apparatus and methods for installing gas lift valve mandrels in coil tubing without cutting the tubing.

It is another object of the invention to provide apparatus for the connection of gas lift valves with coil tubing which will permit disconnection of the gas lift valves from the tubing and reconnection of the valves at another location along the length of the tubing.

It is another object of the invention to provide apparatus and method for the connection of gas lift valves with coil tubing quickly and inexpensively in comparison with prior art practices.

In accordance with the invention, there is provided a gas lift mandrel and method of installation for coil tubing including mandrel body segments formed to fit together around a section of coil tubing, the body having a longitudinal hole to receive the coil tubing, and one of the segments being provided with means for securing a gas lift valve into the body, a flow passage from the gas lift valve communicating into the coil tubing, and a seal between the body segment and the coil tubing to prevent leakage between the coil tubing surface and the body segment from the passage into the coil tubing. One method of installation of the mandrel on the coil tubing includes: providing a crossmark on the outer surface of the horizontal tubing perpendicular to the longitudinal axis of the tubing at the location for the top of the mandrel when installed; providing a longitudinal mark on the outer surface of the tubing parallel with the longitudinal axis of the tubing intersecting the crossmark;, marking, center punching, and drilling a hole along the longitudinal mark at the location of the passageway in the mandrel body segment; and securing the mandrel body segments together around the coil tubing with the top of the mandrel aligned with the crossmark on the coil tubing and the longitudinal center line of the body segment aligned with the longitudinal mark on the coil tubing. Another form of the gas lift mandrel of the invention and the method of installation includes providing an internal threaded hole leading into the mandrel body segment on an axis common with the axis of the body segment passage hole for communicating into the tubing, a pipe plug for closing the hole into the body segment, and installing the mandrel body on the coil tubing by securing the body segments together around the coil tubing, drilling a hole in the coil tubing through the hole leading into the body segment, and closing the hole into the body segment with a pipe plug. The mandrel may be mounted and pressure tested on the coil tubing before drilling the hole into the tubing.

Preferred embodiments and the objects and advantages of the gas lift valve mandrel of the invention will be better understood from the following detailed description taken in conjunction with the accompanying drawings wherein.

Figure 1:
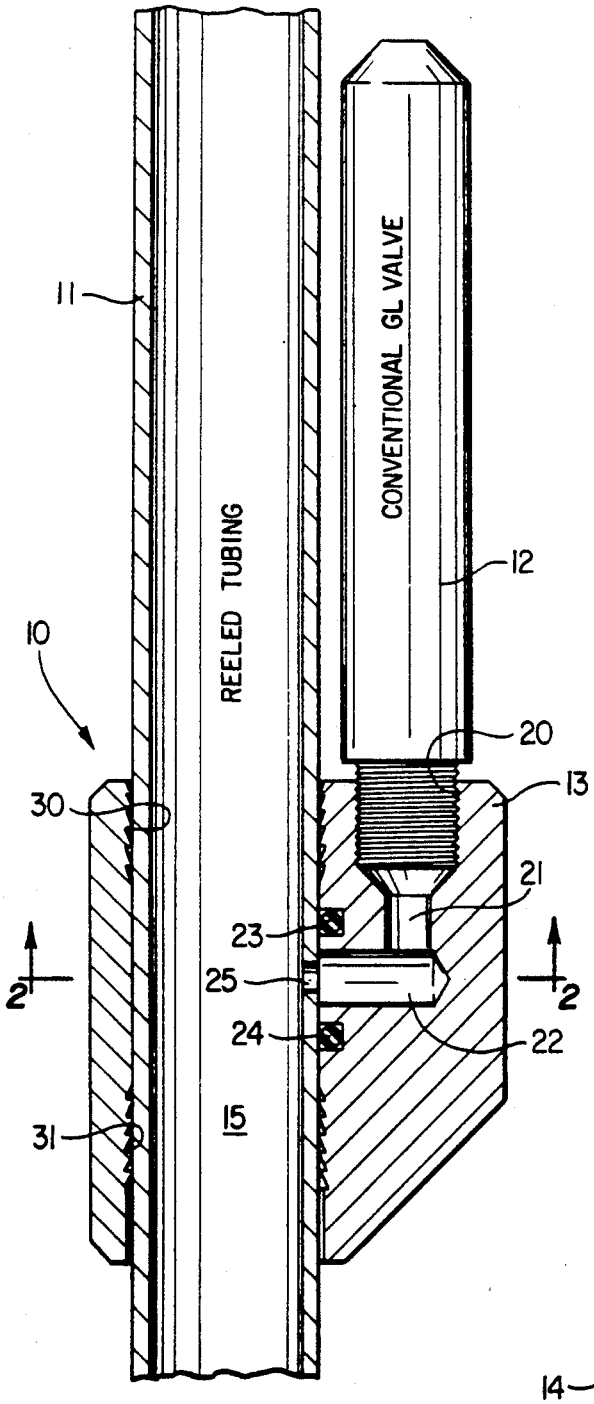
FIG. 1 is a fragmentary longitudinal view in section and elevation of one embodiment of a gas lift valve mandrel and gas lift valve installed on a coil tubing section.
Figure 2:
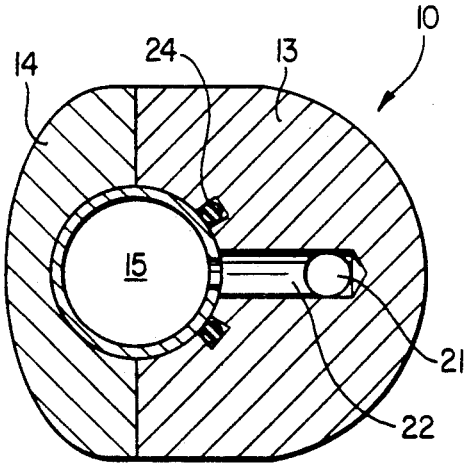
FIG. 2 is a view in section along the line 2—2 of the gas lift valve mandrel and coil tubing shown in FIG. 1.
Figure 4:
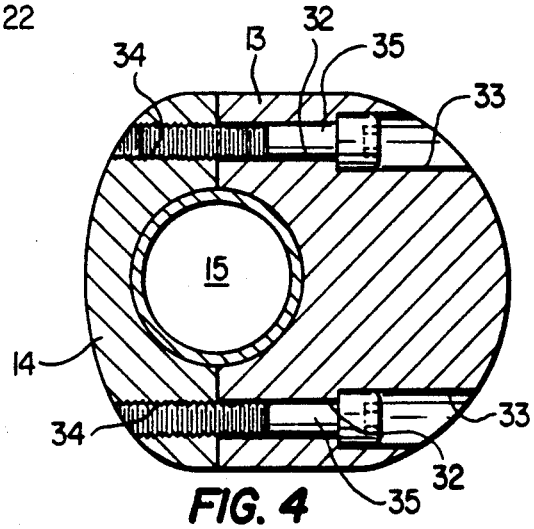
FIG. 4 is a view in section of the gas lift valve mandrel along the line 4—4 of FIG. 3 rotated 90 degrees to the orientation of FIG. 1.
Figure 5:
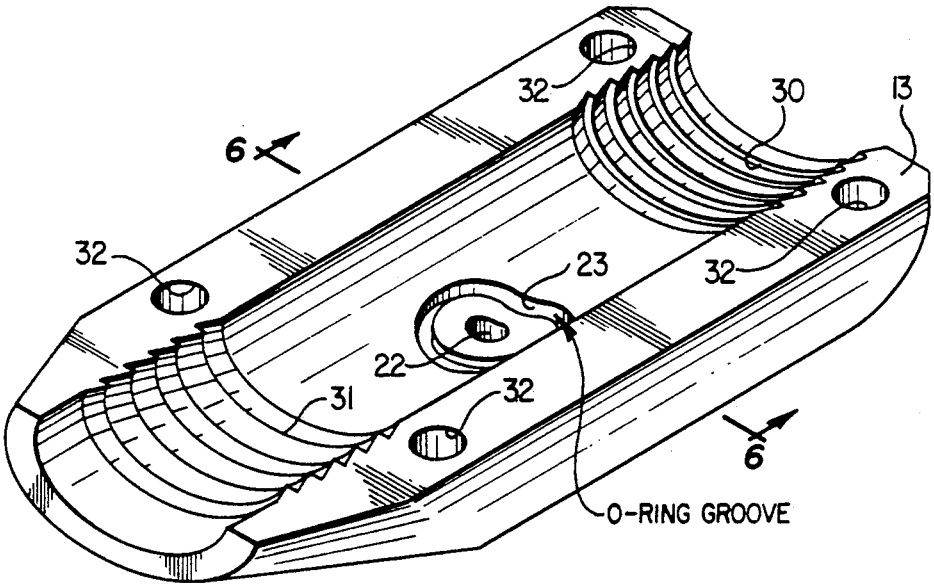
FIG. 5 is an inside view in perspective of the right mandrel body segment or valve adapter as illustrated in FIGS. 1, 2, and 4 showing the O-ring groove around the gas opening into the bore of the mandrel.
Figure 6:
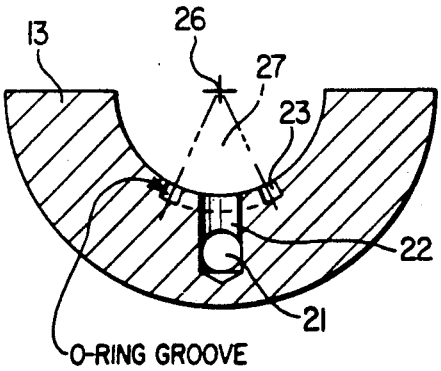
FIG. 6 is a view in section of the body segment along the line 6—6 of FIG. 5.

Referring to the drawings, a gas lift valve mandrel 10 embodying the features of the invention is mounted on reeled or coil tubing 11 for supporting a gas lift valve 12 to admit lift gas into the tubing for producing a well through the tubing by the production method in which lift gas is introduced into the tubing to lift the column and aid in flowing the fluid from a well. The mandrel 10 is formed in two body sections including a valve adaptor 13 and a retainer or clamp 14 secured together around the tubing 11. The adaptor 13 and the clamp 14 of the mandrel are two halves of the mandrel body secured together on the tubing to encircle the tubing as apparent in FIGS. 1, 2, and 4. The mandrel has a longitudinal bore 15, one half of which is formed in the adapter 13, and the other half of which is formed in the clamp 14, so that the adapter and clamp fit together around the tubing with the tubing received in and extending through the bore 15 as evident in FIGS. 2 and 4. The adapter 13 has an internal longitudinal upwardly opening threaded bore 20 for mounting the gas lift valve 12 on the adapter. The adapter bore 20 opens into a vertical gas flow passage 21 which communicates with a horizontal gas flow passage 22 opening into the bore of the mandrel for flow of gas from a gas lift valve mounted on the mandrel into the tubing. An O-ring groove 23 is provided in the surface of the portion of the bore 15 formed in the adapter 13 around the opening of the flow passage 22 into the mandrel bore, as best seen in FIG. 5. The groove 23 is a circular groove uniformly machined into the inside surface of the portion of the mandrel bore in the adapter such that an O-ring installed in the groove will form a positive seal between the adapter and the outside surface of the tubing around an opening 25 in the tubing communicating the passage 22 with the interior of the tubing. The O-ring groove 23 is formed in the adapter 13 around the open end of the passage 22 by a numerical programmed end mill shaping the O-ring groove to receive an O-ring 24. The mill is operated relative to the longitudinal center line axis 26 of the cylindrical inside surface of the adapter 13 to form a groove 23 of uniform cross section. A radius line 27 from the axis 26 extends along a centerline of the square cross section of the groove 23 at any location around the groove. The O-ring forms a positive seal with the outer surface of the reeled tubing around an opening 25 in the tubing communicating the adapter passage 22 with the interior of the tubing. The mandrel is provided with upper and lower slip teeth 30 and 31, respectively, around the bore within the adapter and clamp above and below the O-ring groove 23. The teeth 30 and 32 tightly grip the outer surface of the tubing 11 when the adapter and clamp are secured together around the tubing. The adapter 13 has upper and lower lateral screw holes 32 on opposite sides of the bore 15 each of which has an enlarged outer end portion 33. The clamp 14 has corresponding upper and lower lateral internally threaded screw holes 34 which match the bolt holes 32 in the adapter. Socket head cap screws 35 fit in the adapter screw holes 32 and are threaded into the clamp screw holes 34 to hold the adapter and clamp together around the tubing 11. As evident in FIG. 4, the enlarged outer end portions 33 of screw holes 32 permit the heads of the cap screws 35 to be countersunk in the adapter when the mandrel is mounted on the tubing.

Figure 3:
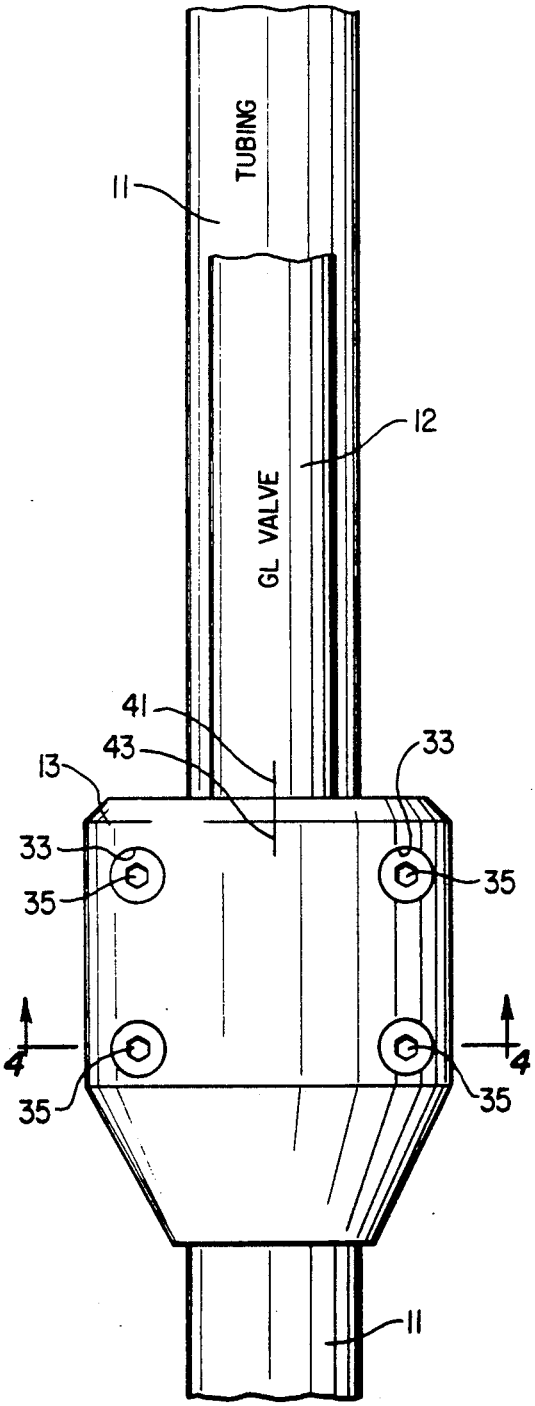
FIG. 3 is a fragmentary right side view in elevation of the gas lift valve mandrel and gas lift valve on the coil tubing as shown in FIG. 1.
Figure 7:
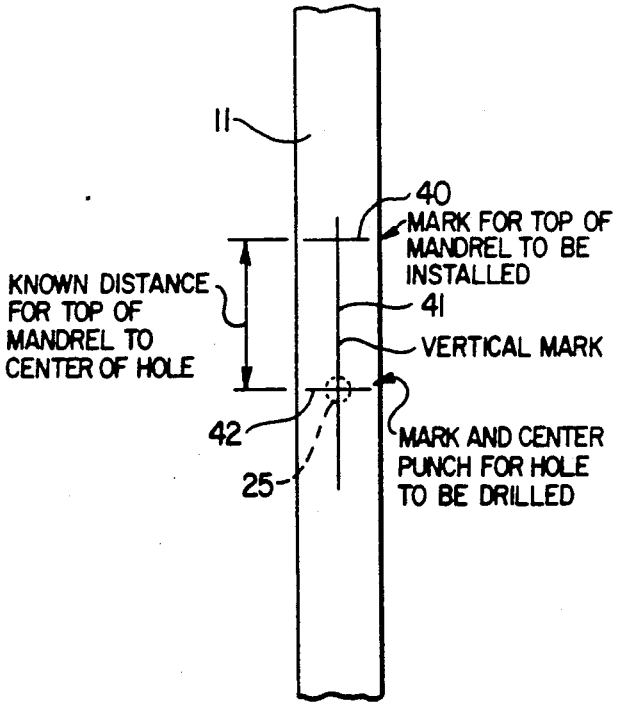
FIG. 7 is a fragmentary view in elevation of the coil tubing section on which the mandrel is installed showing reference marks used in the method of installation of the mandrel on the tubing.

FIG. 7 schematically illustrates a technique of properly locating the mandrel 10 on the coil tubing 11. A mark 40 is made around the portion of the outer surface of the tubing 11 perpendicular to the longitudinal axis of the tubing. A mark 41 is then inscribed along the outer surface of the tubing perpendicular to the mark 40 and extending longitudinally parallel with the longitudinal axis of the tubing. A mark 42 is then inscribed in the outer surface of the tubing crossing the mark 41 at the known distance from the upper end of the mandrel 10 to the center of the lateral passage 22 in the mandrel adapter 13. The intersection of the mark 42 with the longitudinal mark 41 is the location of the center of the hole 25 in the tubing 11. The hole 25 is then drilled in the tubing at the intersection of the mark 41 and 42. A mark 43 is then inscribed along the longitudinal center line of the mandrel adapter 13 as shown in FIG. 3. The adapter 13 is placed on the outer surface of the reeled tubing aligning the top end edge of the adapter with the mark 40 and the longitudinal center mark 43 on the adapter with the longitudinal mark 41 on the tubing. At this position of the adapter, the lateral passage 22 in the adapter is aligned with the flow port or hole 25 in the tubing. Prior to positioning the adapter 13 on the tubing surface, the O-ring 24 is placed in the O-ring groove 23 so that when the adapter is properly located on the tubing the O-ring engages the outer surface of the tubing for sealing between the adapter and the tubing surface around the adapter passage 22 and the tubing port 25. The mandrel clamp 14 is positioned on the opposite side of the tubing in alignment with the adapter 13 and the socket heads cap screws 35 are placed in the screw holes 32 and screwed into the internally threaded screw holes 34 in the clamp until the adapter and clamp are tightly secured together on the tubing forming the mandrel 10. When the adapter and clamp are secured on the tubing, the slip teeth 30 and 31 within the bore of the mandrel engage the outer surface of the tubing securing the mandrel against longitudinal movement such as slippage along the tubing. Preferably, preliminary to mounting the mandrel on the tubing the outer surface area of the tubing is rubbed smooth with emery cloth paying particular attention to the area around the port 25 in the tubing.

After mounting the mandrel on the tubing, the gas lift valve 12 is secured into the mandrel by engaging the externally threaded lower end portion or an appropriate fitting of the gas lift valve into the internally threaded mandrel bore 20.

Figure 8:
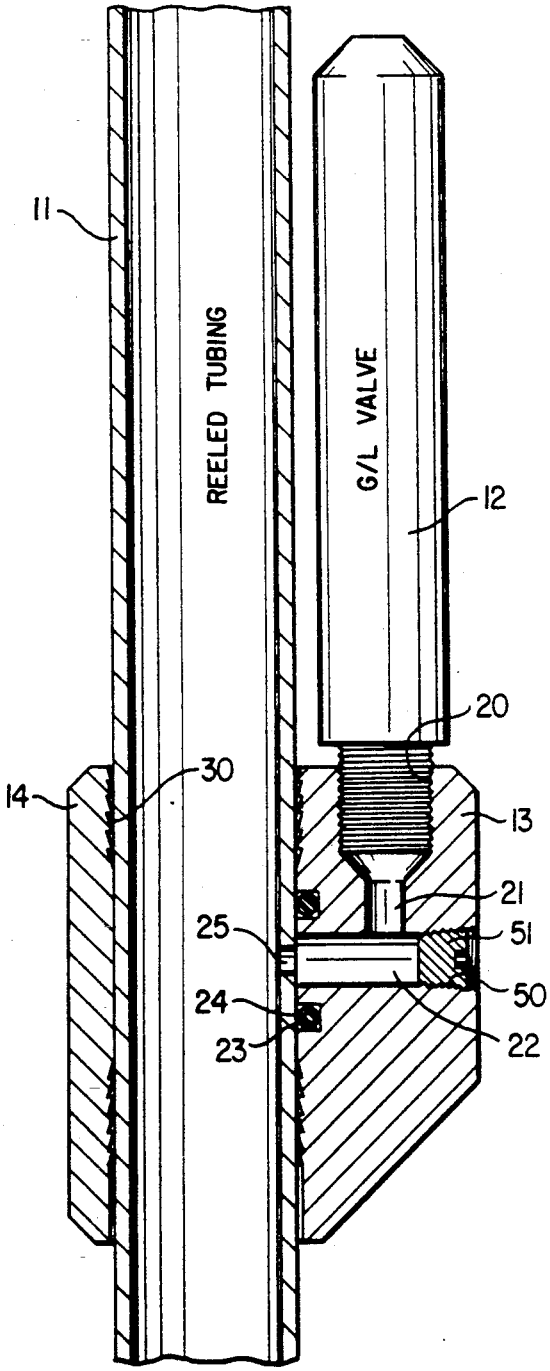
FIG. 8 is a longitudinal view in section and elevation of another embodiment of the mandrel of the invention and a gas lift valve mounted on a section of coil tubing.

FIG. 8 illustrates a modification of the mandrel adapter 13 which permits a different method of mounting the mandrel on the tubing to be used. An internally threaded pipe plug hole 50 is drilled through the outer surface of the adapter 13 into the flow passage 22 along the axis of the flow passage. The use of this modified form of the adapter 3 with the pipe plug hole 50 eliminates the need for the mounting method utilizing the inscribed marks on the tubing surface as illustrated in FIG. 7. The modified adapter 13 and the clamp 14 are secured together on the tubing with the O-ring in place in the O-ring groove 23. Either after positioning the mandrel on the tubing or before, a pipe plug 51 is screwed into the pipe plug hole 50. With the adapter and clamp firmly secured on the tubing by tightening the cap screws 35 and the pipe plug 51 in place the mandrel may be pressured tested by applying a pressure into the mandrel passages 21 and 22 through the internally threaded passage 20. The pipe plug 51 is then removed and the port hole 25 in the tubing is then drilled by inserting a drill through the pipe plug hole 50 and the mandrel passage 22. After drilling the port 25, the pipe plug is replaced in the hole 50 sealing the pipe plug hole. The gas lift valve 12 may then be mounted on or connected into the mandrel at the adapter 13 as illustrated. The use of the modified mandrel adapter illustrated in FIG. 8 eliminates the necessity for the markings on the coil tubing described in FIG. 7 and thus, avoids any alignment problems between the port 25 and the tubing and the mandrel adapter passage 22.

Mandrels 10 with gas lift valves 12 may be mounted on the coil tubing at desired locations along the tubing as the tubing is run into a well using well known apparatus and techniques, such as a lubricator through which the mandrel and gas lift valves may be introduced into a well and standard equipment for running the coil tubing with the mandrel and valves attached into a well. If it is necessary to relocate the mandrels and gas lift valves, the spacing is readily changed by removing the mandrels, welding the ports 25 in the tubing closed, and remounting the mandrels and gas lift valves at other locations as desired.

It will be readily seen that a gas lift valve mandrel in accordance with the invention is inexpensive to manufacturer and can be very quickly installed. The structure of the mandrel and the installation procedures permit gas lift valves to be quickly pulled and serviced by retrieving the coil tubing on which the mandrels are mounted. Conventional threaded production tubing required with prior art gas lift valve mandrels is eliminated. The mandrels may be readily reused. If the spacing of the mandrels and gas lift valves needs changing, the mandrels are quickly removed and reinstalled at other locations along the length of the tubing.

What is claimed is:

1. A mandrel for mounting a flow control valve on a tubing string comprising:

a plurality of mandrel body sections each comprising an arcuate segment adapted to be secured together in end-to-end circumferential array on the tubing to form said mandrel circumscribing the tubing;

the body sections forming a longitudinal bore when secured together with the tubing passing through the bore;

one of the body sections having means for mounting the flow control valve thereon and fluid passageway means for communication between a flow control valve on the mandrel and the bore into a port formed in the tubing opening to the passageway means; and means for sealing between the one body section and the tubing to direct fluid communication between the passageway means and the tubing port.

2. A mandrel in accordance with claim 1 where the means for mounting the flow control valve thereon comprises means for mounting a gas lift valve in communication with said tubing string through said fluid passageway means.

3. A mandrel in accordance with claim 1 where the mandrel includes means for removably securing said mandrel on a reeled tubing.

4. A mandrel in accordance with claim 1 including means for mounting a gas lift valve on said mandrel in communication with said fluid passageway means and means for mounting said mandrel on a reeled tubing with said fluid passageway means opening into said reeled tubing.

5. A mandrel in accordance with claim 1 wherein the body sections are provided with internal slip teeth around the bore for engaging the outer surface of the tubing string.

6. A mandrel in accordance with claim 1 wherein the mandrel body sections comprise a valve adapter and a clamp, said means for sealing, said means for mounting said valve, and said passageway means being formed in said adapter.

7. A mandrel in accordance with claim 6 wherein the adapter and the clamp are provided with means for holding the adapter and the clamp together around the tubing.

8. A mandrel in accordance with claim 1 where the means for sealing comprises an O-ring groove in the one body section around the fluid passageway means into the bore and an O-ring positioned in the groove.

9. A mandrel in accordance with claim 8 where the one body section includes an internally threaded pipe plug hole opening into the fluid passageway means for drilling the port in the tubing when the mandrel is mounted on the tubing and a threaded pipe plug for closing the pipe plug hole after the mandrel is mounted on the tubing and the port is formed in the tubing.

10. A mandrel in accordance with claim 8 where the O-ring groove is circular and of uniform cross section.

11. A mandrel in accordance with claim 10 where the O-ring groove is milled into the one body section bore surface on a longitudinal axis of the bore.

12. A mandrel in accordance with claim 1 in combination with a gas lift valve mounted on said mandrel communicating with said fluid passageway means.

13. A mandrel in accordance with claim 1 in combination with and mounted on a reeled tubing string.

14. A mandrel in accordance with claim 3 in combination with and mounted on a reeled tubing string.

15. A mandrel in accordance with claim 4 in combination with a gas lift valve mounted on said mandrel communicating with said fluid passageway means and a reeled tubing through said longitudinal bore, said mandrel being secured with said reeled tubing.

16. A mandrel for mounting a gas lift valve on a reeled tubing comprising:

a plurality of mandrel body sections each comprising an arcuate segment adapted to be secured together in end-to-end circumferential array on the tubing to form said mandrel circumscribing the tubing;

the mandrel body sections having a longitudinal bore when secured together on the tubing, the tubing passing through the bore;

one of the body sections including means for mounting a gas lift valve and passage means for flow of lift gas from a gas lift valve mounted thereon into the bore through the mandrel body, the passage means opening to a port formed in the tubing; and means for sealing between the one body section and the tubing to direct fluid communication between the passage means and the port.

17. A mandrel in accordance with claim 16 where the means for sealing comprises an O-ring groove machined uniformly into the inside surface of the one body section around the passage means into the bore of the mandrel body and an O-ring disposed in the groove to effect a positive seal between the one body section and the surface of the tubing around the passage means opening to the port in the tubing.

18. A mandrel in accordance with claim 17 wherein the one body section comprises a valve adapter and another of the body sections comprises a clamp securable to the adapter around the tubing for mounting the adapter on the tubing.

19. A mandrel in accordance with claim 18 wherein the adapter includes an internally threaded hole from an outer surface of the mandrel into the mandrel passage means aligned with the passage means to the longitudinal bore for forming the port in the tubing after the mandrel is mounted on the tubing and a pipe plug for closing the internally threaded hole after forming the port and pressure testing the seal means between the body section and the tubing.

20. A mandrel for mounting a gas lift valve on a reeled tubing comprising:

a mandrel body formed by a valve adapter for supporting the valve on the tubing and a clamp connectible with the adapter around the tubing for holding the adapter on the tubing, the body being provided with a longitudinal bore when the adapter and clamp are secured together on the tubing, the tubing passing through the bore;

the adapter being provided with means for mounting the gas lift valve on the adapter, passage means for flow of lift gas from the gas lift valve to an opening of the passage means into the bore for flow of lift gas from the gas lift valve through the passage means into the bore to a port formed in the tubing, an O-ring groove having a uniform cross section formed in the surface of the adapter defining the adapter portion of the bore around the opening of the passage means into the bore, and holes for securing means in longitudinal and laterally spaced relation for securing opposite end portions of the adapter with the clamp by securing means extending between the adapter and the clamp along opposite sides of the tubing;

an O-ring sized to fit in the O-ring groove in the adapter to effect a positive seal between the adapter and the tubing around the opening of the passage means into the bore when the adapter is secured on the tubing;

the clamp having holes formed in longitudinal and lateral spaced relation in alignment with the holes in the adapter for the securing means between the adapter and the clamp;

securing means sized to fit in the holes in the adapter and the clamp to extend between the adapter and the clamp to secure the adapter and clamp together on the tubing to form the mandrel body on the tubing; and internal slip teeth formed in the adapter and the clamp around the bore of the body when the mandrel is mounted on the tubing to engage the tubing surface for holding the mandrel in place on the tubing.

21. A mandrel in accordance with claim 20 wherein the holes in the adapter are cap screw holes, the holes in the clamp are internally threaded screw holes, and the securing means between the adapter and clamp are socket head cap screws.

22. A mandrel in accordance with claim 20 wherein the adapter is provided with a hole formed from the outer surface of the adapter into the passage means in the adapter in alignment with the opening of the passage means into the adapter bore portion for drilling the port in the tubing through the passage means in the adapter when the adapter is mounted on the tubing, and means for closing the hole into the adapter after the port is formed in the tubing.

23. A mandrel in accordance with claim 22 where the hole in the adapter into the passage means is an internally threaded pipe plug hole and the means for closing the hole is a threaded pipe plug.

24. A mandrel in accordance with claim 23 wherein the holes in the adapter are cap screw holes, the holes in the clamp are internally threaded screw holes, and the securing means between the adapter and clamp are socket head cap screws.

* * * * *